US007361153B1

(12) United States Patent
Martin

(10) Patent No.: US 7,361,153 B1
(45) Date of Patent: Apr. 22, 2008

(54) TOOL FOR MANIPULATING THE PATELLA AND PATELLAR TENDON

(76) Inventor: Dennis W. Martin, 1316 S. Buchanan Way, Aurora, CO (US) 80018

( * ) Notice: Subject to any disclaimer, the term of this patent is extended or adjusted under 35 U.S.C. 154(b) by 332 days.

(21) Appl. No.: 10/847,156

(22) Filed: May 17, 2004

(51) Int. Cl.
*A61H 7/00* (2006.01)
*A61H 39/04* (2006.01)

(52) U.S. Cl. ..... 601/135; 601/137; 24/214; 606/204

(58) Field of Classification Search ..... 601/134–138, 601/1, 141, 139; 602/23, 26, 62; 606/237, 606/238, 201, 204; D24/211, 212, 214, 215
See application file for complete search history.

(56) References Cited

U.S. PATENT DOCUMENTS

| | | | | |
|---|---|---|---|---|
| 560,351 | A * | 5/1896 | Goetze | 601/114 |
| 5,044,626 | A * | 9/1991 | Parker, Jr. | 482/44 |
| 5,231,977 | A | 8/1993 | Graston | |
| 5,366,437 | A | 11/1994 | Graston | |
| 5,441,478 | A | 8/1995 | Graston | |
| 5,707,346 | A | 1/1998 | Graston | |
| 6,077,239 | A * | 6/2000 | Lin | 601/137 |
| 6,126,620 | A | 10/2000 | Graston | |
| 6,149,616 | A * | 11/2000 | Szlema et al. | 602/62 |
| 2001/0051778 | A1 * | 12/2001 | Sevier et al. | 601/137 |

* cited by examiner

*Primary Examiner*—Danton DeMille
(74) *Attorney, Agent, or Firm*—Sheridan Ross PC

(57) ABSTRACT

A tool for manipulating and mobilizing the patella and patellar tendon following injury to the knee or surgery thereon to reduce pain, reduce the formation of scar tissue about the patella and eliminate stiffness and loss of range of motion of the knee, is formed by an elongated, rigid bar having a first end, a second end and an elongated portion extending between the ends. The elongated portion has a central section intermediate the ends defining a V-shaped notch. The first end defines a generally rectangular flattened blade having a lateral beveled edge. The second end defines a generally triangular flattened blade having a lateral arcuate beveled edge. An elastomeric coating is provided on the central section defining the V-shaped notch, on the rectangular blade and on the triangular blade. A method for using the tool is also described.

10 Claims, 4 Drawing Sheets

TOOL FOR MANIPULATING THE PATELLA AND PATELLAR TENDON

BACKGROUND OF THE INVENTION

1. Field of the Invention (Technical Field)

The present invention relates to physical therapy tools, and more particularly to a tool for manipulating and mobilizing the patella and patellar tendon following injury or knee surgery.

2. Background Art

Tools and methods for soft tissue massage therapy are shown in U.S. Pat. Nos. 5,231,977, 5,366,437, 5,441,478, 5,707,346 and 6,126,620 to D. A. Graston. These tools are used by a therapist or trainer to apply pressure to the skin of a patient for removal of fibrous scar tissue adhesions underlying the skin.

SUMMARY OF THE INVENTION

The present invention is embodied in a tool for manipulating and mobilizing the patella and patellar tendon following injury to the knee or surgery thereon to reduce pain, reduce the formation of scar tissue about the patella and eliminate stiffness and loss of range of motion of the knee. The tool is formed by an elongated, rigid bar having a first end, a second end and an elongated portion extending between said ends. The elongated portion has a central section intermediate said ends defining a V-shaped notch. The first end defines a generally rectangular flattened blade having a lateral beveled edge. The second end defines a generally triangular flattened blade having a lateral arcuate beveled edge. An elastomeric coating is applied on said central section defining said V-shaped notch, on said rectangular blade and on said triangular blade.

DETAILED DESCRIPTION OF THE PREFERRED EMBODIMENTS

Figure 1:
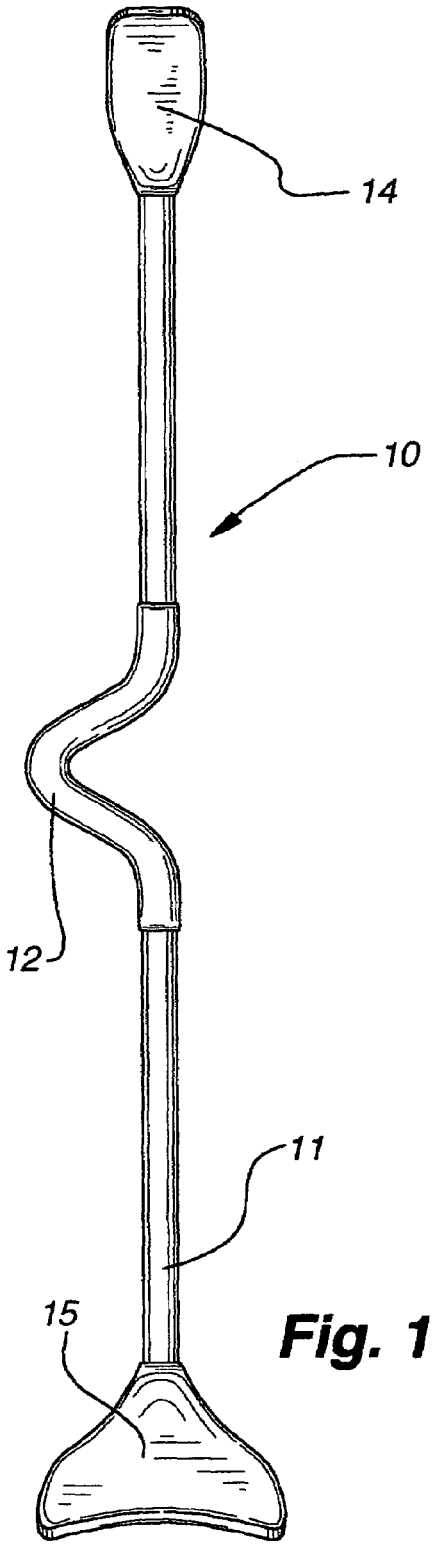
FIG. 1 is a top plan view of a tool embodying the present invention.
Figure 2:
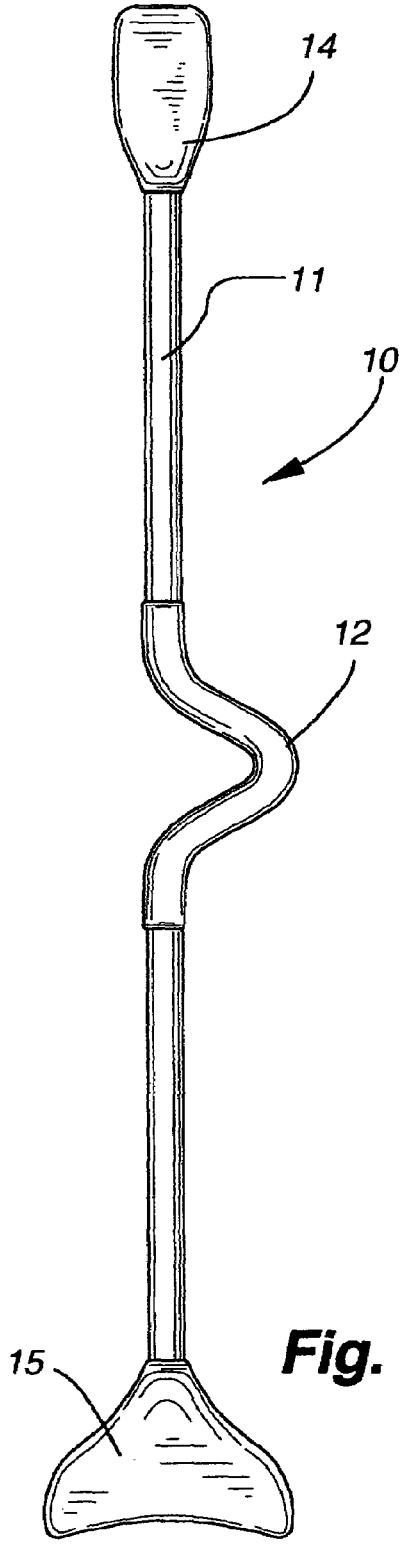
FIG. 2 is a bottom plan view of the tool shown in FIG. 1.
Figure 3:
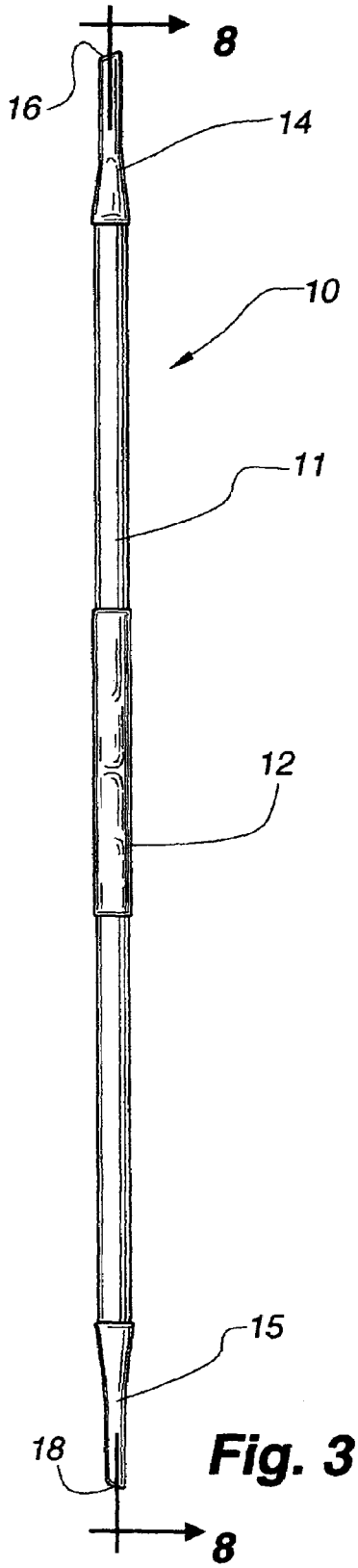
FIG. 3 is a front side elevation view of the tool shown in FIG. 1.
Figure 4:
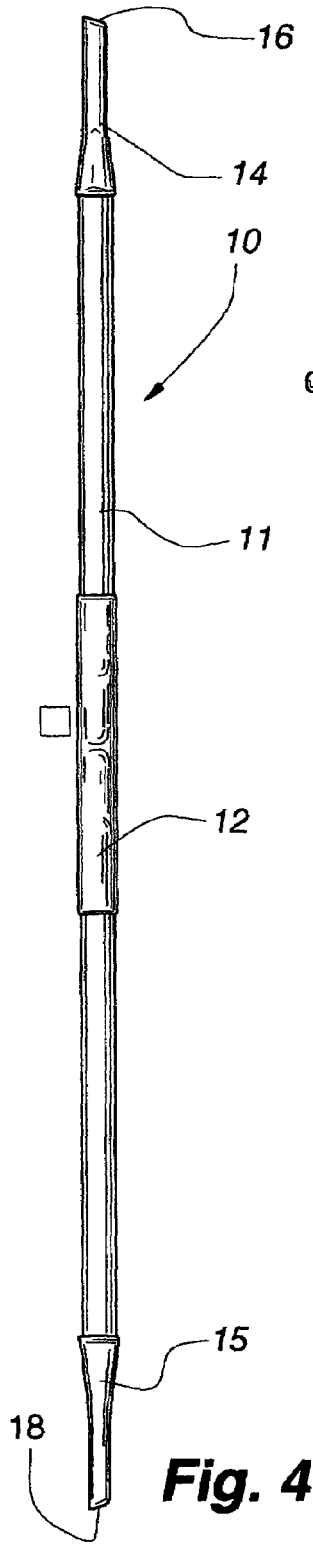
FIG. 4 is a rear side elevation view of the tool shown in FIG. 1.
Figure 5:
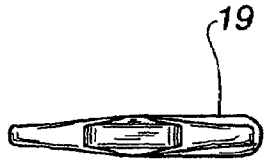
FIG. 5 is a right end elevation view of the tool shown in FIG. 1.
Figure 6:
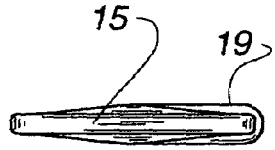
FIG. 6 is a left end elevation view of the tool shown in FIG. 1.
Figure 7:
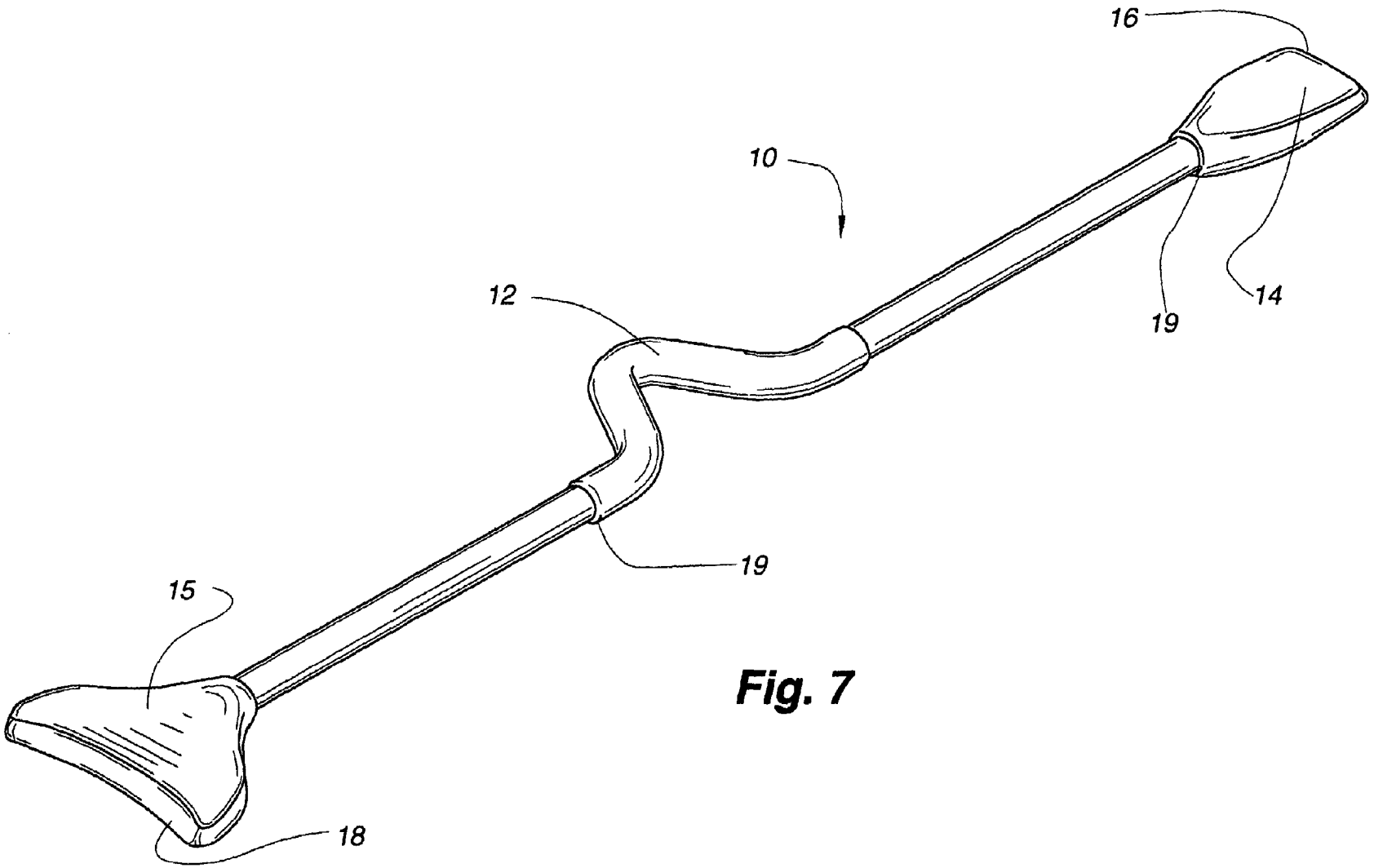
FIG. 7 is a perspective view of the tool shown in FIG. 1.
Figure 8:
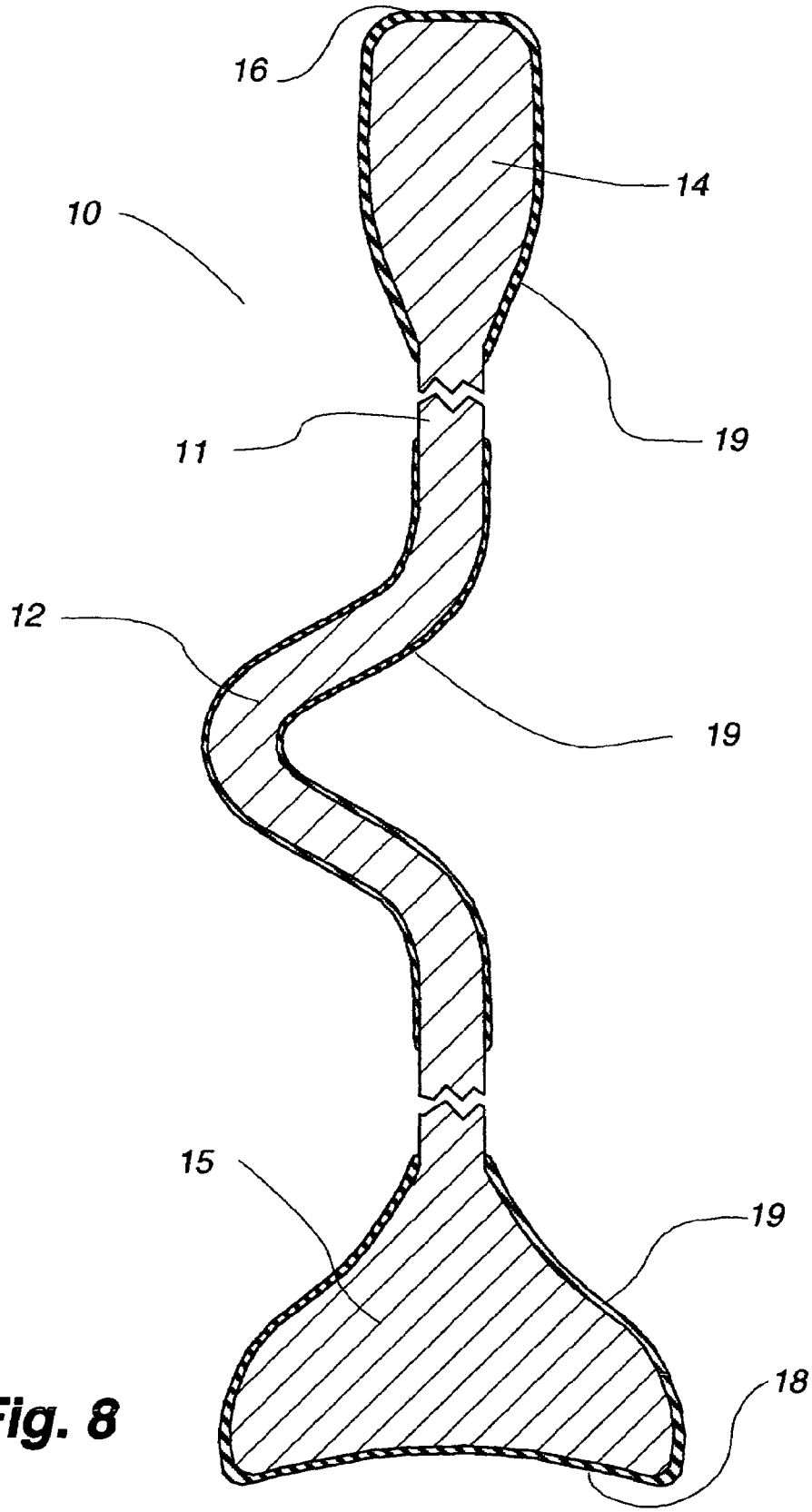
FIG. 8 is a longitudinal section view taken substantially in the plane of line 8-8 on FIG. 3.

The present invention is embodied in a tool 10 shown in the drawings, formed from a stiff, strong rod 11 of stainless steel or like metal, glass fiber material or other rigid plastic material. The rod is circular or other appropriate cross-section. Formed centrally in the rod is a V-shaped notch. Each end of the rod is flattened to form blades or paddles 14, 15. At one end the blade 14 is rectangular in shape, with the outer lateral edge 16 beveled. At the other end the blade 15 is triangular in shape, with the outer lateral edge 18 concave arcuate in form and beveled. One or more of the lateral edges may be blunt or rounded.

The central V-shaped notch section 12 and each of the blades 14, 15, is coated with an elastomeric coating 19 such as a resilient plastic or rubber material having a tacky feeling surface.

In one mode of the present invention, the tool 10 is formed from a stainless steel rod of circular cross-section. The rod 11 is about ⅜ inches in diameter, and about 16 inches long. The blades 14, 15 are each about 1⅛ inches long and 3/16 inches thick. The triangular blade 15 is about 1½ inches wide at its outer lateral base, and the lateral width of the rectangular blade 14 is about 1 inch. The lateral outer edges of the blades have a 20 degree bevel. The V-shaped notch 12 is approximately 1 inch deep with a minimum inner radius. The blades and notch area are coated with a about 3 to 6 coatings of a plastic material commercially available under the name "Plasti-Dip."

In an alternative mode, the rectangular blade 14 may be replaced by a handle formed of a 2½ inch dowel or like material. Other shapes of handles may be used.

The knee bar described above is designed to manipulate and mobilize the patella, or knee-cap, and the patellar tendon which connects the patella and the tibia. The patellar tendon is often subjected to trauma secondary to surgery, usually surgery on the anterior cruciate ligament, or cumulative trauma like running or jumping. This region often becomes engulfed in scar tissue and can become shortened (patellar baja) resulting in pain, stiffness, reduced range of motion and function. A chronically shortened patellar tendon caused by an abundance of scar tissue can have devastating effects on the articular cartilage at the end of weight bearing bones behind the patella. Manipulation and in particular mobilization using the tool 10 has an improving effect on reducing pain, reducing the formation of scar tissue about the patella and eliminating stiffness and loss of range of motion to the knee of the patient.

One of the functions of the triangular patella blade 15 is to place a blade 15 on the superior (top) pole of the patella and push or drive the patella inferiorly or down. Such inferior patella mobilization lengthens the quadriceps tendon as well as underlying plicae. To perform a lateral patella glide, the blade 15 is placed alongside the patella and a force is applied to drive the patella laterally. This lateral patella glide lengthens the medial (inside) capsular tissues and loads the lateral retinaculum. A medial patella glide can be performed in a similar manner by placing blade 15 on the lateral or outside border of the patella and driving the patella medially inside.

Further, while holding the blade 15 on the medial border and performing a lateral patellar glide, the lateral or outside border of the patella may be manually lifted to place an aggressive stretch on the lateral retinaculum.

The V-shaped notch or bend 12 is used to perform a superior or up longitudinal patellar glide. The apex of the V-shaped notch 12 is placed just above the inferior pole of the patella. The area where the notch 12 tapers into the shaft of the knee tool 10 is placed just off either side of the inferior pole of the patella, making firm contact with the side of the patella, and the rod is pulled upwardly to perform the superior patella glide. The superior patella mobilization lengthens the patellar tendon and underlying fat pad. Either medial or lateral patellar tendon mobilization or glide serves to loosen tethered tendon and fat pad tissue from the underlying tibial plateau. This provides an open anterior interval (the space between the patellar tendon and tibial plateau).

The use of the rectangular blade 14 to perform a patellar tendon mobilization or glide on a patient takes stress of the hands of the user performing the technique. The patient's knee may be straight or in various degrees of knee flexion or bending. The arcuate contour of blade 15 fits nicely into the crease of the user's elbow. This allows a comfortable purchase point for the care provider while using the blade 14 to perform the desired mobilization of the patella and patellar tendon.

The tacky grip of the material on the blades 14, 15 and V-shaped portion 12 allows a firm, secure and comfortable purchase onto the patella and or patellar tendon. The primary goal of the knee bar 10 is to mobilize the patella and maintain the patella mobility. It utilizes a dry mobilizing technique with no ointments or lotions. Furthermore, the tool 10 is designed to avoid blunt pressure on inflamed soft tissue about the knee.

The tool may be formed in a variety of cross-sectional configurations. The basic criterion is to avoid injury to the patient during manipulation and in particular mobilization of the patella and patellar tendon. The tool may, in various configurations described above, be utilized by a trainer or therapist, as well as by a patient in an in-home environment.

Various applicable equivalents will be appreciated by those in the therapeutic arts, and the invention is intended to be interpreted according to the scope of the appended claims including applicable equivalents.

The invention claimed is:

1. A tool for manipulating and mobilizing the patella and patellar tendon, comprising:

an elongated, rigid bar about 16 inches in length having a first end, a second end and an elongated portion extending between said ends;

said elongated portion having a central section intermediate said ends defining a substantially V-shaped notch;

said first end defining a generally rectangular flattened blade having a lateral beveled edge;

said second end defining a generally triangular flattened blade having a lateral arcuate beveled edge; and an elastomeric coating on at least one of said central section, said first end and said second end.

2. The tool according to claim 1, wherein said lateral arcuate beveled edge is at about 1½ inches wide.

3. The tool according to claim 1, wherein said tool is adapted to provide a first purchase between said lateral arcuate beveled edge and a bicep of a user, and a second purchase between said elongated central portion and a hand of said user for mobilizing said patellar tendon.

4. The tool according to claim 1, wherein said V-shaped notch, said first end and said second end may be used to mobilize said patellar tendon beyond a end range of said patellar tendon.

5. The tool according to claim 1, wherein said tool is adapted to mobilize the patella medially.

6. The tool according to claim 1, wherein said tool is adapted to perform superior and inferior patella glide mobilizations beyond a end range of said patellar tendon.

7. The tool according to claim 1, wherein said tool is adapted for a user to mobilize said patella of said user.

8. The tool according to claim 1, wherein said tool is adapted for a user to mobilize said patella of another.

9. The tool according to claim 1 wherein said tool is adapted to stretch the lateral retinaculum.

10. A physical therapy tool comprising:

an elongated central portion comprising a concave section;

said elongated central portion further comprising a first end section and a second end section;

said first end section defining a lateral beveled edge;

said second end section defining a lateral arcuate beveled edge;

wherein said concave section and said second end section are dimensioned to receive a contour of a superior or a inferior pole of a human patella, wherein said first end section is dimensioned to abut said superior or said inferior pole of said human patella, and wherein said concave section, said first end section and said second end section are adapted to mobilize said human patella beyond a tissue end range of said human patella;

wherein a length of said tool is sufficient to allow said tool to rest longitudinally along a forearm of a user such that a first purchase of said tool is made between said lateral arcuate beveled edge and a bicep of said user, and a second purchase of said tool is made between said elongated central portion and a hand of said user;

wherein said length of said tool is about 16 inches.

* * * * *